US005170716A

United States Patent [19]

Durand et al.

[11] Patent Number: 5,170,716

[45] Date of Patent: Dec. 15, 1992

[54] DEVICE FOR APPLYING A FORCE TO THE UNDERFRAME OF A RAILWAY VEHICLE, FOR THE INCLINATION OF THE UNDERFRAME OR THE TRANSVERSE STABILIZATION OF THE VEHICLE

[75] Inventors: Charles R. Durand; Jérôme, C. Durand, both of Corlay, France

[73] Assignee: ANF-Industrie, Crespin, France

[21] Appl. No.: 623,722

[22] PCT Filed: Jun. 23, 1989

[86] PCT No.: PCT/FR89/00323

§ 371 Date: Dec. 21, 1990

§ 102(e) Date: Dec. 21, 1990

[87] PCT Pub. No.: WO89/12565

PCT Pub. Date: Dec. 28, 1989

[30] Foreign Application Priority Data

Jun. 24, 1988 [FR] France ..... 88 08498
Jul. 1, 1988 [FR] France ..... 88 08906

[51] Int. Cl.[5] ..... B61F 5/00
[52] U.S. Cl. ..... 105/199.2
[58] Field of Search ..... 105/199.1, 199.2, 199.3, 105/453; 180/165; 280/6.12, 755, 704

[56] References Cited

U.S. PATENT DOCUMENTS

| | | | |
|---|---|---|---|
| 2,093,486 | 9/1937 | Schoepf et al. | 105/199.2 |
| 2,124,124 | 7/1938 | Schoepf et al. | 105/199.2 |
| 3,701,397 | 10/1972 | Shiran et al. | 105/199.2 |
| 3,902,691 | 9/1975 | Ott | 246/167 R |
| 4,069,767 | 1/1978 | Glaze | 105/199.2 |
| 4,091,738 | 5/1978 | Platner | 105/453 |

FOREIGN PATENT DOCUMENTS

| | | |
|---|---|---|
| 0032158 | 7/1981 | European Pat. Off. . |
| 0184960 | 6/1986 | European Pat. Off. . |
| 2001282 | 7/1970 | Fed. Rep. of Germany . |
| 2156613 | 5/1973 | Fed. Rep. of Germany . |
| 3213804 | 10/1983 | Fed. Rep. of Germany . |
| 2231550 | 12/1974 | France . |
| 2245515 | 4/1975 | France . |
| 2340216 | 9/1977 | France . |
| 2079701 | 1/1982 | United Kingdom . |

*Primary Examiner*—Robert J. Oberleitner
*Assistant Examiner*—Mark T. Le
*Attorney, Agent, or Firm*—Jacobson, Price, Holman & Stern

[57] ABSTRACT

A device for applying a tilting force on the body of a railway vehicle comprises elements for detecting and calculating the force to be applied, and hydraulic cylinder-piston devices (12, 12') having a reversible action from the energy point of view by taking or reconstituting energy from or to at least one hydraulic accumulator (26). Hydraulic cylinder devices (12, 12') are fed by two motor-pumps (70, 72) interconnected mechanically by a shaft (74), one motor-pump having hydraulic inlets and outlets connected, with a high pressure accumulator (26) and a low pressure feeder (28), respectively, and the other motor-pump having inlets and outlets connected with the chambers of the cylinder-piston devices. One of the two motor-pumps (70, 72) has a variable capacity, the variation in the capacity being controlled by the elements for detecting and calculating the force to be applied.

7 Claims, 4 Drawing Sheets

DEVICE FOR APPLYING A FORCE TO THE UNDERFRAME OF A RAILWAY VEHICLE, FOR THE INCLINATION OF THE UNDERFRAME OR THE TRANSVERSE STABILIZATION OF THE VEHICLE

This application relates to copending U.S. patent application Ser. No. 07/613,646, filed Dec. 20, 1990, now allowed in the names of the same inventors.

BACKGROUND OF THE INVENTION

The present invention relates to railway vehicles and more particularly to a device adapted to apply on the body of the vehicle a force for tilting the body about a longitudinal axis, or a force compensating for the centrifugal and centripetal forces acting on the vehicle in a curve, of the type comprising at least one force-applying hydraulic cylinder device and elements for detecting and calculating the force to be applied.

It will be recalled that the tilt of the vehicle body about an axis which is longitudinal or parallel to the track is a means employed on certain passenger railway vehicles for reducing the discomfort of the passengers resulting from the fact that the vehicle travels through the curves at a speed which is higher—and sometimes lower—than the equilibrium speed corresponding to the natural cant of the track. Depending on whether the vehicles travel through the curve above or below the equilibrium speed, the passengers are exposed to accelerations which are, relative to the floor of the car, respectively centrifugal or centripetal, this being all the more true because cars which have no body tilting equipment and a conventional suspension in a low bearing plane, tilt in the wrong direction (they lean toward the exterior of the curve when the speed is higher than the equilibrium speed and lean toward the interior of the curve in the opposite case).

Disregarding the passive systems whose suspension plane is higher than the center of gravity of the body and whose performances are poor owing to the inertias involved and to the relatively weak return action of the forces of gravity, a certain number of studies, and even constructions, exist which are based on active devices whose purpose is to return the body to a set position more rapidly than the aforementioned passive systems.

To the set position corresponds an apparent gravity force (resulting from the gravity force of the earth and the centrifugal acceleration force due to the curve) whose component parallel to the floor of the car is, in certain cases, nil and, in other cases, has a limited value; to minimize the effect on the passenger of transverse accelerations parallel to the floor of the vehicle, that constitutes a spatial reference for the passenger placed inside the vehicle.

The commercial interest of the body tilt is to improve the comfort of the passenger for given speeds in curves or, for a given comfort, increase the speed in the curves.

BRIEF SUMMARY OF THE INVENTION

The present invention has in particular as an object to provide a contribution to the systems of the active type which may be classified in two categories which are the following:

1st category: the body tilt is achieved by means of mechanical parts connecting two solid parts of the vehicle, the sole purpose of which is to ensure the degree of freedom of rotation about the longitudinal axis: it concerns pins and bearings or an assembly of links. The motion of relative rotation between the two aforementioned solid parts is obtained by these mechanical parts and the required energy is supplied through cylinder devices placed between the two solid parts in question. This type is the most widely used and is for example illustrated by the German document DE-A-2 001 282 or British document GB-A-2 079 701;

2nd category: the body tilt is achieved without the necessity to materialize the axis of rotation by means of machined mechanical parts. It is sufficient to compress the suspension, usually the secondary suspension, on one side of the vehicle and to allow it to extend on the other side, the energy to be supplied for causing the movement being transmitted, as before, through cylinder devices, but this time the cylinder devices are placed in parallel with the suspension. This category is illustrated for example by the French document FR-A-2 231 550 or German document DE-A-2 156 613.

The invention is applicable to the two aforementioned categories even if, for reasons of simplification, the figures and commentaries which follow refer exclusively to the tilt systems of the second category.

The invention also concerns a phenomenon accompanying the increase in speed on sinuous lines which must be taken into account jointly with the body tilt when higher speeds are in fact desired to be employed on such lines. What is found and is well known, derives from the fact that in increasing the speed in a given curve, the transverse forces transmitted to the track ineluctably vary as the square of the speed. Apart from the forces on the track itself, the rolling stock takes up all the plays available transversely which results in a deterioration of the comfort, as will be explained.

The plays involved have essentially two sources: the play of the axles in the rail and the play between the abutments of the secondary suspension. The primary suspension is itself designed to have a certain stiffness conditioned by the stability and, as it usually does not have abutments, is not harmful.

The taking up of the plays in a curve on the axles is caused by a bad operation of the axles; consequently the front axle of each truck copies the defects on the inner rounded portion of the outer rail of the curve. It is advisable under these conditions to conform to the constructional prescriptions set forth in the patent application PCT/FR 89/00310 filed on Jun. 19, 1989, which corresponds to U.S. patent application Ser. No. 07/613,860, filed Dec. 17, 1990, now abandoned.

As concerns the conventional secondary suspensions, i.e. the passive suspensions, they are based on the principle of high flexibility, moreover both vertically and transversely, so as to filter the defects of the track. But the filtering no longer occurs for the geographical accidents. Thus, in a curve, the secondary suspension bottoms in an unpleasant manner at the moment of entering the curve, and this is all the more so with a more flexible secondary transverse suspension and, furthermore, owing to the planing of the outer rail by the flange of the wheels. The bottoming, even against an elastic abutment, is the cause of a transmission to the interior of the body of unpleasant vibrations throughout the time during which the curve is travelled through.

The remedy for this problem is known: it consists in applying on the body of the vehicle a force opposed to the centrifugal force exerted on the body during passages through a curve. Thus, for example, in respect of a body suspended conventionally by means of passive suspensions, there must be applied to the body during passages through the curves a system of forces equivalent to a centripetal force substantially parallel to the plane of the track at the place at which the vehicle is located, applied at the center of gravity of the body and substantially equal to the centrifugal force thus exerted on the body minus the centripetal component due to the natural cant of the track.

The determination of the system of forces to be applied to the body of the vehicle is not part of the present invention.

The invention has the further object, within the framework of a device of the type mentioned at the beginning of this specification, to improve the performances of such devices by means of a special arrangement.

More precisely, according to the invention, the force-applying element is a hydraulic element having a reversible action from the energy point of view by taking off or restoring the energy from or to at least one hydraulic accumulator. Such an arrangement permits, for obtaining the desired result, employing only a minimum amount of energy owing to the recuperation of energy.

An arrangement of this type has been described in the patent application PCT/FR 89/00266 filed on May 31, 1989, which corresponds to U.S. patent application Ser. No. 07/613,646, filed Dec. 20, 1990; the content of which is incorporated in the present application by reference. In this application, the principle of recuperation of energy is employed for damping the oscillatory motions of the railway vehicle, whereas, according to the present invention, this principle is employed for the body tilt or the transverse compensation of the centrifugal force.

In an advantageous arrangement of the invention, the double-acting hydraulic cylinder device for applying the force is fed from one of the motor-pumps of a group of two motor-pumps whose shafts are interconnected and whose inlets and outlets are connected, for one, with a high pressure accumulator and a low pressure feeder and, for the other, with the two chambers of the cylinder device.

One of the two motor-pumps has a variable capacity, the variation in the capacity being controlled by the elements for detecting and calculating the force to be applied.

According to a less advantageous arrangement, since it operates on an on-off principle, the signal leaving the processing circuit can be sent to a driving element having three positions controlling through the same mechanical shaft, three directional control valves which open hydraulic circuits to the double-acting cylinder device or the two double-acting cylinder devices. The hydraulic connections are, on one hand, to a high pressure oil reservoir—also termed hydraulic accumulator—and, on the other hand, to a low pressure oil feeder connected to the atmosphere. The reserve of high pressure oil is possibly reconstituted by means of a pump controlled by a pressure controller so as to maintain a constant pressure in the accumulator. The connection is achieved by two directional control valves as a function of the direction of the signal delivered by the processing circuit so as to bring about the desired motions of rotation or transverse motion when the cylinder device or cylinder devices must accelerate the motion of the body in one direction or the other. When, on the contrary, the speed of rotation of the body is suitable, or when the body is subjected to no significant force on the part of the transverse cylinder device, i.e. if the signal delivered by the processing circuit is lower than a fixed threshold, the cylinder device or cylinder devices are isolated from the accumulator and from the feeder and connected as a by-pass by a third direction control valve.

The transverse stabilization or the stabilization in rotation about the longitudinal axis of a railway body may be achieved jointly with a system for damping the vertical motion according to the device described in the aforementioned patent application PCT/FR 89/00266 (U.S. patent application Ser. No. 07/613,646). This permits the pooling of a certain number of elements conditioned by the two or three stabilizations and will be described in more detail hereinafter.

But still more generally, the invention may be integrated into a system in which both the vertical motions and the horizontal motions are each the object of a stabilization and therefore of a damping.

According to another characteristic of the invention, it may be of interest, when it is made to contribute in a tilting system of the aforementioned second category, to neutralize, when this is possible, the energies involved in the compression and decompression of the springs, or at least, to minimize them so as to reduce the capacity of the hydraulic accumulator. This is possible for the pneumatic suspension. For this it is sufficient to put the cushions in communication through a large-section pipe and a valve which will be opened each time the pressure difference between the two cushions exceeds a predetermined threshold, but any other criterion announcing a large motion of orientation will be capable of likewise serving to control the opening of the aforementioned valve.

BRIEF DESCRIPTION OF THE DRAWINGS

Further characteristics and advantages of the invention will be apparent from the following description, with reference to the accompanying drawings wherein.

DETAILED DESCRIPTION

Figure 1:
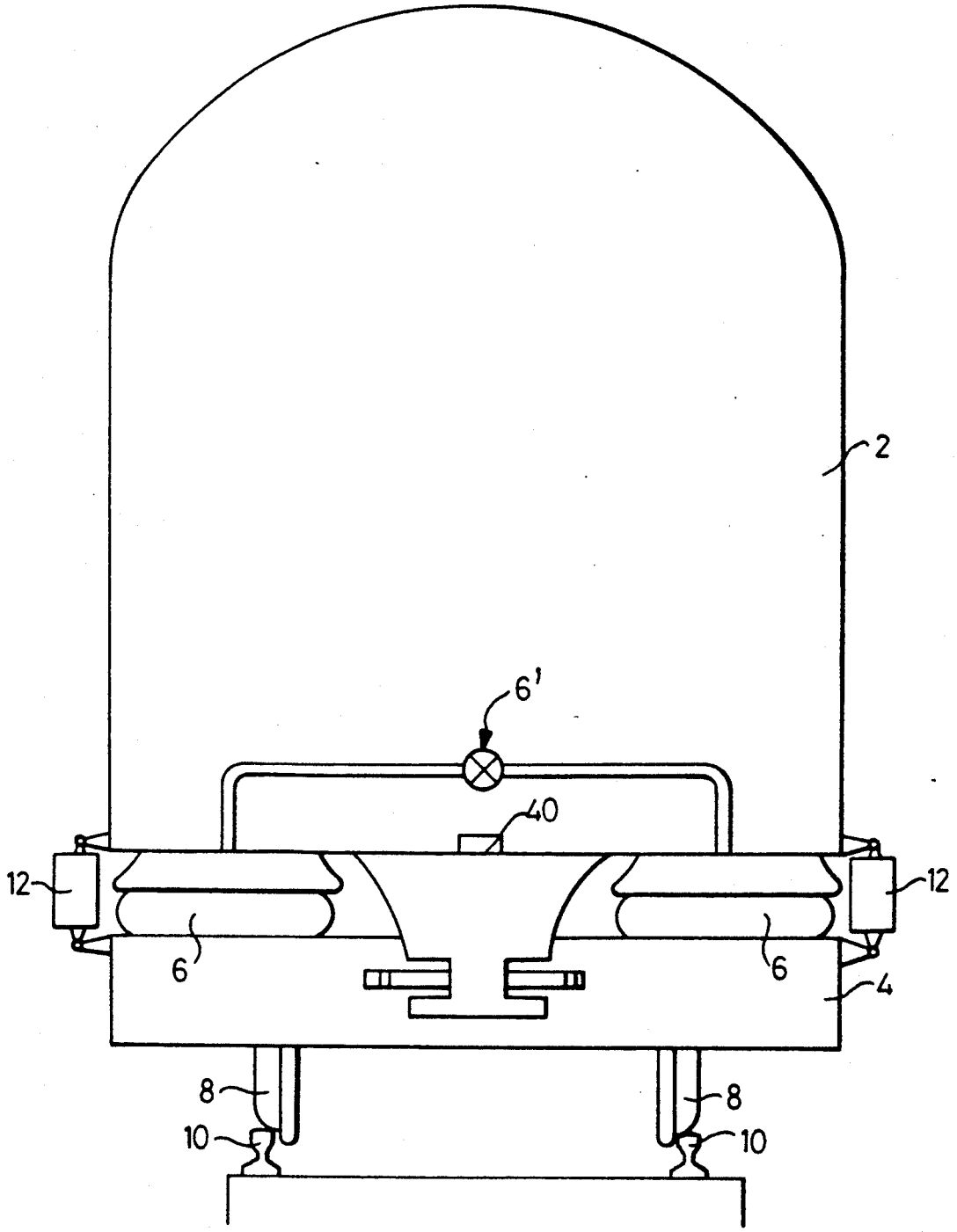
FIG. 1 is a schematic cross-sectional view of a body of railway rolling stock, showing the implantation of the tilt stabilization cylinder devices.

Returning to FIG. 1, there are shown in cross-section the conventional components of a body tilt, i.e. a body 2 of railway rolling stock bearing on a truck frame 4 through a secondary suspension 6. The truck frame is itself supported, through a primary suspension not shown, by means of wheels 8 which roll along rails 10. Tilt hydraulic cylinder devices 12 are engaged between the body 2 and the truck frame 4 and cause a rotation about the longitudinal axis in accordance with orders given by a servomechanism diagrammatically represented in FIG. 2 and itself receiving tilt information, for example from an accelerometer 40 having a substantially transverse axis connected to the body and disposed in the latter as close as possible to the longitudinal axis of rotation; but the body tilt information may also be given by other known means, such as memories of the line synchronized with the position of the vehicle on the line, etc.

When the accelerometric signal delivered by the accelerometer 40 corresponds to a significant acceleration of the body in the direction toward the right (for example in a right-hand curve), the cylinder device 12 placed on the right side of the body is compressed while the left cylinder device 12 is extended so as to compensate for at least a part of the centrifugal force by the earth gravity component. The situation is the opposite when the transverse body acceleration itself changes direction.

Lastly, when the transverse body acceleration is below a minimum threshold, no order is given to the tilt cylinder devices.

The principle of operation of the body tilt such as described hereinbefore conforms to the prior art and is assumed to be known. Devices constructed in accordance with this principle may be improved, in the case where the secondary suspension is a pneumatic suspension, by inserting between the two pneumatic cushions 6 a differential valve having the reference numeral 6' in FIG. 1 so as to reduce the force to be overcome for positioning the body in rotation about the longitudinal axis. Of course, in this case the levelling valves associated conventionally with the pneumatic cushions (the function of which is to maintain a constant height of the cushions by pneumatic inflation or deflation) must be at the same time neutralized.

Figure 2:
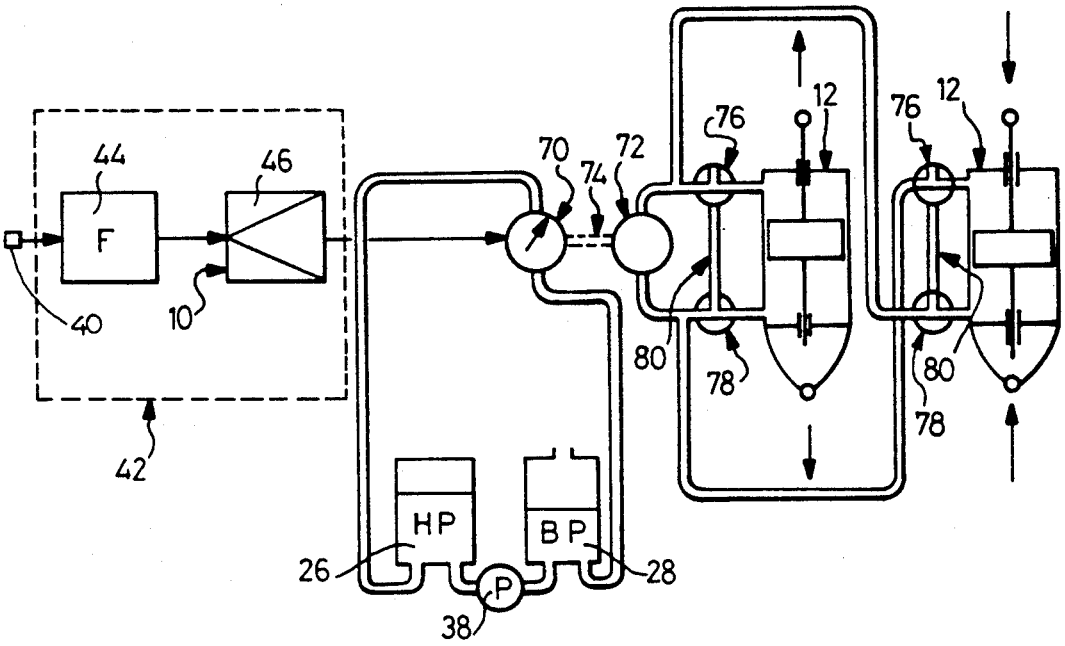
FIG. 2 is a diagrammatic view of operation of the tilt control.

In FIG. 2 there is shown diagrammatically the operation of the control which is of conventional type. As an example, there has been considered here for tilting the body the signal delivered by an accelerometer 40 which is thereafter inserted in a processing circuit 42 constituted by a filter 44 (according to test results, this filter could possibly be eliminated) followed by an amplifier 46 receiving conventionally apart from the accelerometric signal an anticipation signal 10. The latter may be taken from an accelerometer placed in an ahead position in the same train so as to be re-entered, after the suitable time delay, into the amplifier-saturator 46.

The elements effecting the body tilt or the power elements of the servomechanism conform to one of the arrangements described in the aforementioned patent application PCT/FR 89/00266 (U.S. patent application Ser. No. 07/613,646) and comprise two hydraulic motor-pumps 70 and 72 interconnected by a shaft 74 and hydraulically connected, one to the high and low pressure reservoirs 26 and 28, and the other to the two chambers of the double-acting cylinder devices 12. One of the two motor-pumps has a variable capacity and the latter is modified as a function of the output of the processing circuit 42.

Figure 5:
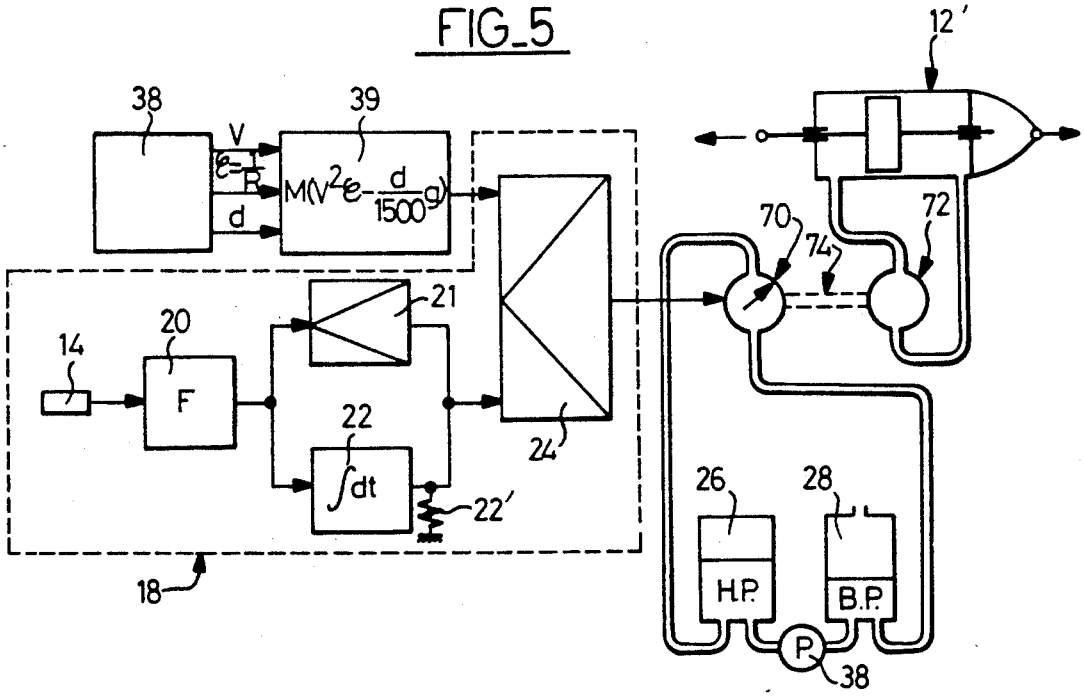
FIG. 5 is a diagrammatic view of a lateral control operation structure.
Figure 3:
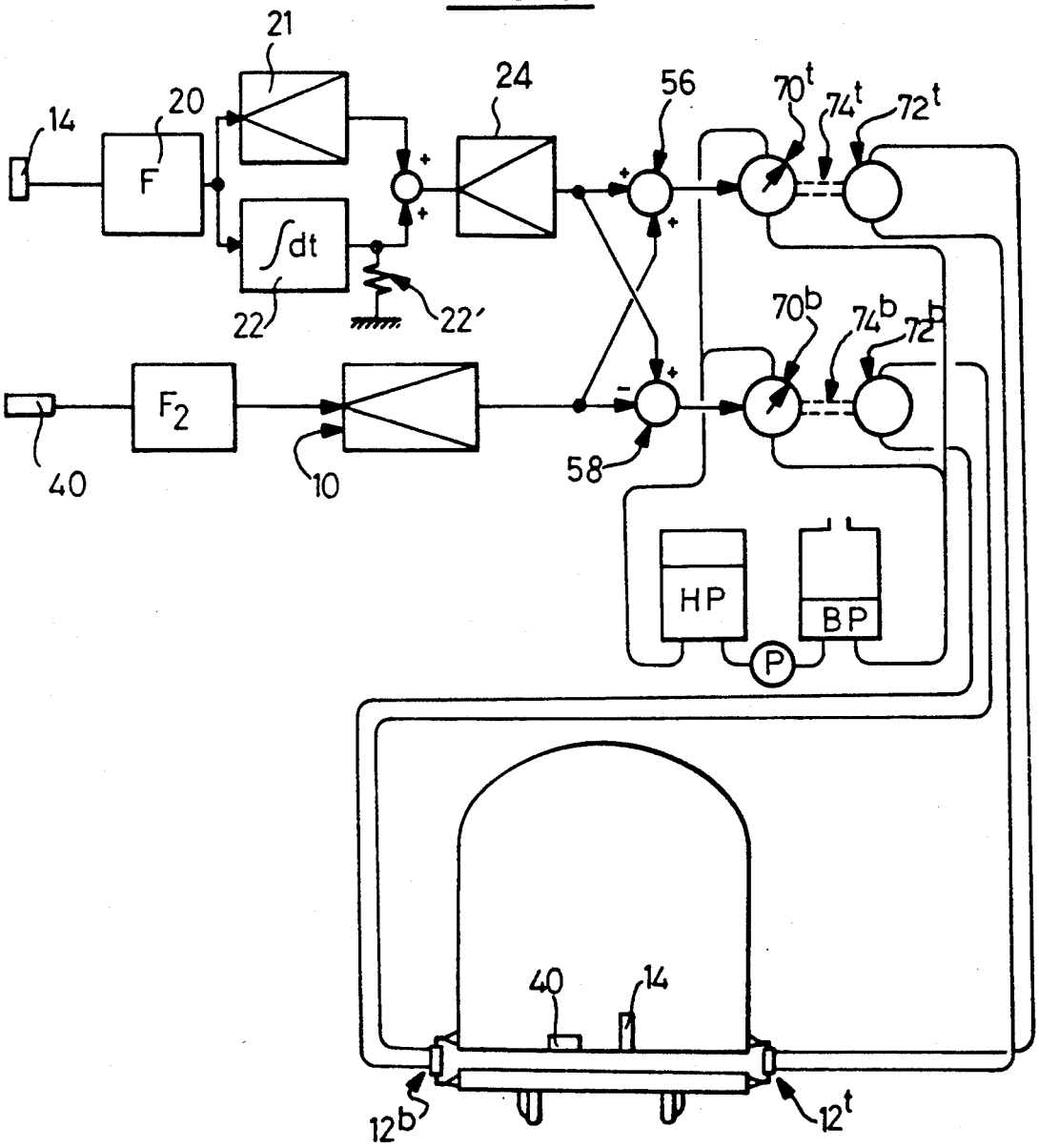
FIG. 3 is a view similar to FIG. 2 of operation of a stablization of a body tilted about the longitudinal axis combined with a vertical stabilization.

With reference to FIGS. 2, 5 and 3, the operational relationship between the two separated hydraulic fluid circuits connected to motor pump 70 and motor pump 72 respectively is not hydraulic buy mechanical. The two motor pumps are linked by shaft 74.

The motor-pump 70 has a variable capacity which is controlled by the output signal delivered by the circuit 42 or 18.

Let us assume that the railway vehicle enters a curved portion of the railroad, e.g. a right curve. The corresponding lateral acceleration is sensed by the accelerometer 40 and the circuit 42 or 18 delivers a signal modifying the capacity of the motor-pump 70 (said capacity was nil before because the vehicle was on a straight line) so that the motor-pump 70 starts to rotate and the torque is transmitted through the shaft 74 to the motor-pump 72, which creates differential pressure in the cylinder piston unit 12 or 12' on opposite sides of the piston to produce relative displacement between the piston and cylinder which causes the body to tilt in a direction and up to an extent such that a component of the gravitational forces parallel to the floor compensates that of the centrifugal force due to the curve.

When leaving the curve, the accelerometer 40 delivers a signal which, through the control circuit, entails a reduction of capacity of the motor-pump 70, so that the rotation of shaft 74 is reversed as the driving torque imposed on the motor-pump 72 due to the forces exerted by the body on the cylinder-piston unit 12 or 12' is higher than the potential torque of the motor-pump 70; this motor-pump 70 is then passive and causes oil from the lower-pressure reservoir BP 28 to return to the high-pressure reservoir HP 26.

Depending on results of on-line tests, it can be decided whether it is desirable to install an automatic pump 38 which, as a complement of the lateral pumping, ensures a constant pressure difference between the high and low pressure reservoirs.

It will be observed that the described system is an open-loop servocontrol system: there corresponds in a steady state (stationary state) to a horizontal acceleration detected by the accelerometer a value of the force applied by the cylinder devices 12 which, on one side of the body compresses the secondary suspension and on the other side relieves it. But it is possible, without departing from the scope of the invention, to employ closed-loop servocontrols according to a known technique. The criteria of compensation: total compensation, partial compensation according to a fixed rate, compensation up to a ceiling, etc. are not part of the invention and are to be chosen according to criteria of appropriate physiological comfort.

It will moreover be observed that the body motion is achieved by a system taking off energy from its energy reserve or, on the contrary, regenerating it, at least partly, according to the phases of the motion and according to the same principle as that described in the aforementioned PCT patent application. The hydraulic pipes are dimensioned as large as possible so as to increase the energy regeneration to the maximum extent.

It will be noted lastly that the motion of rotation such as that just described hardly interferes in the general vertical motion resulting from the body suspension. At the very most there is a certain braking of the vertical motions owing to pressure drops in the pipes. If these brakings are not sufficient to brake the vertical body motions, conventional dampers acting jointly with the cylinder devices should be added. They are not shown in FIG. 1.

According to another characteristic of the invention, in body tilting systems constructed in accordance with the arrangement shown in FIG. 2, it is possible to return in the event of emergency to a suspension of conventional type by the action of directional control valves 76 and 78. The latter are shown in FIG. 2 in the position where the body tilting device is in normal operation. If a bad operation of the tilting system is found by automatic detectors or by the personnel on board the vehicle or train, directional control valves 76 and 78 may be automatically or manually shifted, as the case may be, through a quarter of a turn in the clockwise direction. The electric and hydraulic body tilting servocontrol is then isolated from the cylinder devices 12. The latter then behave as ordinary dampers in which the oil is throttled in calibrated tubes 80 which interconnect the directional control valves 76 and 78.

FIG. 3 shows as an example how to achieve joint operation of a body tilt stabilization according to the characteristic of the present invention and an overall vertical motion stabilization according to the arrangement disclosed in the aforementioned patent application PCT/FR 89/00266 (U.S. patent application Ser. No. 07/613,646) now allowed.

A system controlling the vertical motion identical to that described in this patent application produces a vertical motion correction signal which is sent through adders 56 and 58 to two power systems controlling the lateral cylinder devices 12. This control system comprises an accelerometer having a substantially vertical axis 14, possibly a filter 20, then an integrator 22 and its discharge circuit 22 connected in parallel with an amplifier 21, then an amplifier 24 which produces the vertical body motion control signal.

Together with the control signal of the vertical motion of the whole of the body mentioned hereinbefore there is produced according to the same arrangements as those referred to in respect of FIG. 2, a body tilt control signal. The latter is added or subtracted with the suitable sign with respect to the vertical motion control signal in these adders 56 and 58. The signals issuing from these adders are then sent to two actuating systems or power elements constituted by the same components as those described with reference to FIG. 2, except that each of the systems feeds only a single cylinder device. The components of these two systems, including the cylinder devices 12 they feed, carry the same references as in FIG. 2 to which the index "b" or the index "t" are added, depending on whether they refer to a double-acting cylinder device placed on the starboard side or the port side of the body.

Figure 4:
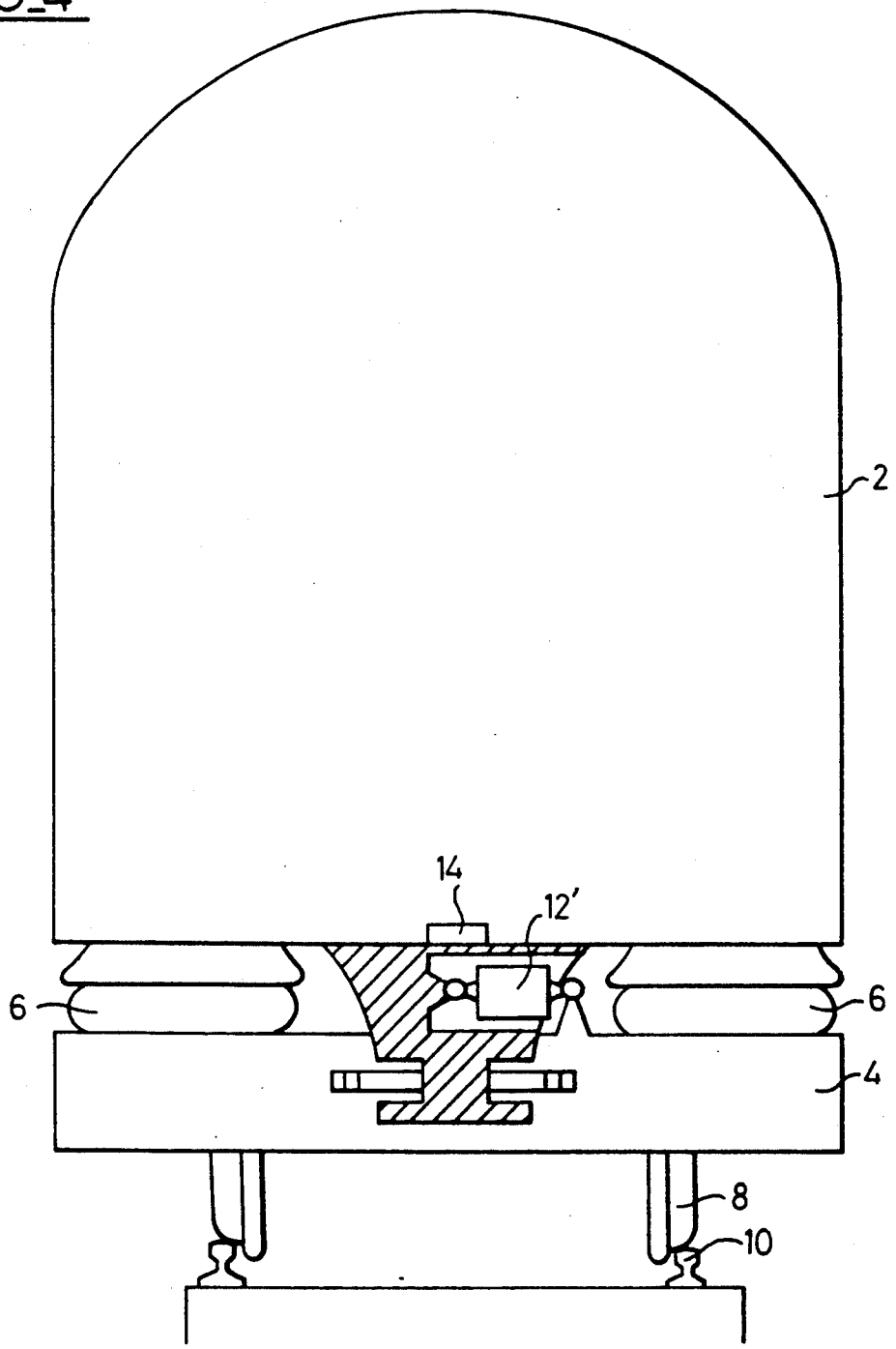
FIG. 4 is a view similar to FIG. 1 showing the implantation of a lateral body stabilization cylinder device.

Reference is now made to FIGS. 4 and 5 for explaining the control device for the lateral stabilization according to another aspect of the invention.

In FIG. 4 there is shown a body 2 resting on a truck frame 4 (possibly on an axle for rolling stock having solely axles) through a secondary suspension 6. The frame 4 bears (through possibly a primary suspension not shown) on wheels 8 which roll along rails 10. The body is stabilized by a double-acting hydraulic cylinder device 12' exerting horizontal and transverse forces between the body and the frame 4. The cylinder device 12' is fed from a high pressure reservoir 26, the oil pass pressure being received in a low pressure reservoir 28.

The control of the lateral stabilization shown in FIG. 5 is effected by means of a signal delivered by an accelerometer 14 having a substantially horizontal axis fixed to the body. The accelerometric signal is processed in a processing circuit 18 comprising possibly a filter 20 (high-pass), an integrator 22 and a discharge circuit 22' connected in parallel with an amplifier 21. The resulting signal constitutes for the circulation of the vehicle in a straight line the signal controlling the transverse motions of the body. This signal needs to be completed in curves by a signal representing the centrifugal force uncompensated by the natural cant of the track which assumes substantially the following value when the body inclination is effected in the manner indicated in FIGS. 4 and 5.

$$M(V^2/R - gc/1500)$$

where M represents the fraction supported by the truck in question of the mean value of the mass of the body, V the travelling velocity of the vehicle, R the radius of the considered curve, c the value of the cant of the track expressed in millimeters (standard 1,500 mm wide track) and g the acceleration due to the gravity of the earth.

In the example taken from FIG. 5, the signal is obtained from a tachometric and localizing central unit 38 delivering the elements of velocity and path followed through ($C=1/R$ and c).

The correction signal (slow motion having a topographical evolution) is calculated in the calculator 39 and added, with the suitable sign, to the signal controlling the transverse body motions (rapid motions) at the input of an amplifier 24.

The actuating system of the servomechanism, the subject matter of the invention, comprises, by way of example, two motor-pumps 70 and 72 mechanically interconnected by the shaft 74 and hydraulically connected, one with a high pressure accumulator 26 and a low pressure feeder 28, the other with the two chambers of the cylinder device 12'. Further, one of the motor-pumps has a variable capacity, the latter being controlled by the signal issuing from the amplifier 24.

Note finally that the invention may be applied to a vehicle where all of the vertical, horizontal and tilting about a longitudinal axis motions are controlled by an active suspension of the type described herein for merely the transverse motions.

We claim:

1. In a device for applying a compensating force on a body supported on a frame of a railway vehicle for compensating for other forces on said body including at least one hydraulic cylinder-piston means comprised of a piston operating in a cylinder, and detecting and calculating means for detecting and calculating the force to be applied, the improvement comprising:

at least one double acting hydraulic cylinder-piston means operatively connected between the frame and the body;

high pressure accumulator means mounted on the vehicle;

low pressure fluid feeder means mounted on the vehicle;

two reversible motor-pump means mounted on the vehicle;

shaft means operatively connecting said two motor-pump means so that rotation of either one of said motor-pump means rotates the other of said motor-pump means;

inlet and outlet means for each of said motor-pump means;

inlet and outlet means for each of said accumulator and feeder means;

two pressure chambers in said at least one hydraulic cylinder-piston means on opposite sides of said piston thereof;

first fluid conduit means between said outlet means of said accumulator means and one of said inlet and outlet means of one of said motor-pump means;

second fluid conduit means between the other of said inlet and outlet means of said one of said motor-pump means and said inlet of said feeder means;

third fluid conduit means between said outlet of said feeder means and said inlet of said accumulator means for feeding hydraulic fluid from said feeder means to said accumulator means;

fourth fluid conduit means between one of said inlet and outlet means of the other of said motor-pump means and one of said chambers; and fifth fluid flow conduit means between the other of said inlet and outlet means of said other of said motor-pump means and the other of said chambers;

one of said motor-pump means having a variable capacity, the variation of said capacity being controlled by said detecting and calculating means for detecting and calculating the force to be applied, so that operation of one of said motor-pump means by said detecting and calculating means operates the other of said motor-pump means via said shaft means for operating said at least one hydraulic cylinder-piston means for applying force to said body relative to said frame for compensating for said other forces on said body.

2. The device as claimed in claim 1 wherein:

said force applying device applied a tilting force about a longitudinal axis of said body and said other forces are tilting forces;

said at least one hydraulic cylinder-piston means comprises first and second double acting hydraulic cylinder-piston means; and further comprising sixth fluid conduit means between one of said chambers of said first cylinder-piston means and one of said chamber of said second cylinder-piston means; and seventh fluid conduit means between the other of said chambers of said first cylinder-piston means and the other of said chambers of said second cylinder-piston means;

said first and second cylinder-piston means being connected between said frame and said body on opposite sides of said vehicle so that said first and second cylinder-piston means exert respective applied tilting forces on said body in opposite directions.

3. A device as claimed in claim 1, wherein said other forces are tilting forces on said body tending to tilt said body about a longitudinal axis thereof and further comprising:

pneumatic cushion means between said frame and said body for providing a resistance to said other tilting forces on said body relative to said frame; and said device for applying said tilting force is controlled by said detecting and calculating means for at least partly neutralizing said resistance of said cushion means in curves when said applied tilting produces excessive forces on said cushion means.

4. A device as claimed in claim 2 and further comprising:

pneumatic cushion means between said frame and said body for providing a resistance to said other tilting forces on said body relative to said frame; and said device for applying said tilting force is controlled by said detecting and calculating means for at least partly neutralizing said resistance of said cushion means in curves when said applied tilting produces excessive forces on said cushion means.

5. A device as claimed in claim 3 wherein:

said cushion means comprises two pneumatic cushion devices in spaced relationship adjacent opposite sides of said vehicle; and differential valve means are interposed between said two pneumatic cushion means, said differential valve means being adapted for opening in response to a pressure difference between said two cushions which exceeds a predetermined threshold pressure.

6. A device as claimed in claim 4 wherein:

said cushion means comprises two pneumatic cushion devices in spaced relationship adjacent opposite sides of said vehicle; and differential valve means are interposed between said two pneumatic cushion means, said differential valve means being adapted for opening in response to a pressure difference between said two cushions which exceeds a predetermined threshold pressure.

7. A device as claimed in claim 1 wherein:

said other forces are centrifugal forces; and said at least one hydraulic cylinder-piston means comprise double acting hydraulic cylinder-piston means mounted between said body and said frame for applying a transversal force to said body for compensating for said centrifugal forces.

* * * * *